United States Patent [19]

Loreto

[11] 4,286,415

[45] Sep. 1, 1981

[54] METHOD OF EDGING LENSES

[75] Inventor: Wilfredo P. Loreto, Hoffman Estates, Ill.

[73] Assignee: AIT Industries, Inc., Schaumburg, Ill.

[21] Appl. No.: 144,067

[22] Filed: Apr. 28, 1980

Related U.S. Application Data

[62] Division of Ser. No. 19,767, Mar. 12, 1979, Pat. No. 4,233,784.

[51] Int. Cl.[3] ..... B24B 1/00

[52] U.S. Cl. ..... 51/284 E; 51/283 E

[58] Field of Search ... 51/101 LG, 105 LG, 106 LG, 51/165.71, 165.72, 165.87, 165.88, DIG. 33, 281 R, 283 E, 284 E

[56] References Cited

U.S. PATENT DOCUMENTS

| | | | |
|---|---|---|---|
| 1,610,638 | 12/1926 | White | 51/101 LG |
| 2,164,155 | 6/1939 | Lemay | 51/101 LG |
| 2,723,501 | 11/1955 | Lueck et al. | 51/101 LG |
| 3,691,698 | 9/1972 | Schaller | 51/165.88 |
| 3,782,046 | 1/1974 | Schaap et al. | 51/165.87 |
| 3,835,591 | 9/1974 | Cimprich | 51/DIG. 33 |
| 3,992,826 | 11/1976 | Nakaoka et al. | 51/165.72 |
| 4,020,601 | 5/1977 | Gray | 51/165.87 |
| 4,176,498 | 12/1979 | Vulich et al. | 51/101 LG |
| 4,233,784 | 11/1980 | Loreto | 51/105 LG |

*Primary Examiner*—Harold D. Whitehead
*Assistant Examiner*—K. Bradford Adolphson
*Attorney, Agent, or Firm*—Gary, Juettner & Pyle

[57] ABSTRACT

A method of grinding the peripheries of articles such as ophthalmic lenses and the like with a grinding wheel to a predetermined outline or edge configuration, is characterized by the steps of detecting the height of discrete positions on the grinding wheel surface between opposite sides thereof and generating signals having values representative of the height of the positions. The values of the signals are compared, and an indication is generated of the position on the grinding surface whereat the signals represent greatest height. The indication is then used to control movement of the article against the highest position on the grinding surface for being ground. In consequence, the wheel wears evenly, it retains a substantially cylindrical shape, all portions of its grinding surface are effectively used in grinding articles, and formation of a groove in its surface is prevented, whereby the wheel does not require retruing or reshaping and its useful life is significantly increased.

13 Claims, 10 Drawing Figures

88
CLOCK
50
MICROPROCESSOR

CONTROL BUS
ADDRESS BUS
DATA BUS
ROM
54
RAM
52
90
PIA-1
A/D
84
S/H
82
LOW PASS FILTER
80
PIA-2
92
INTERVAL TIMER
94
SENSOR
44
LIMIT SWITCH
96
DRIVER CIRCUIT
56

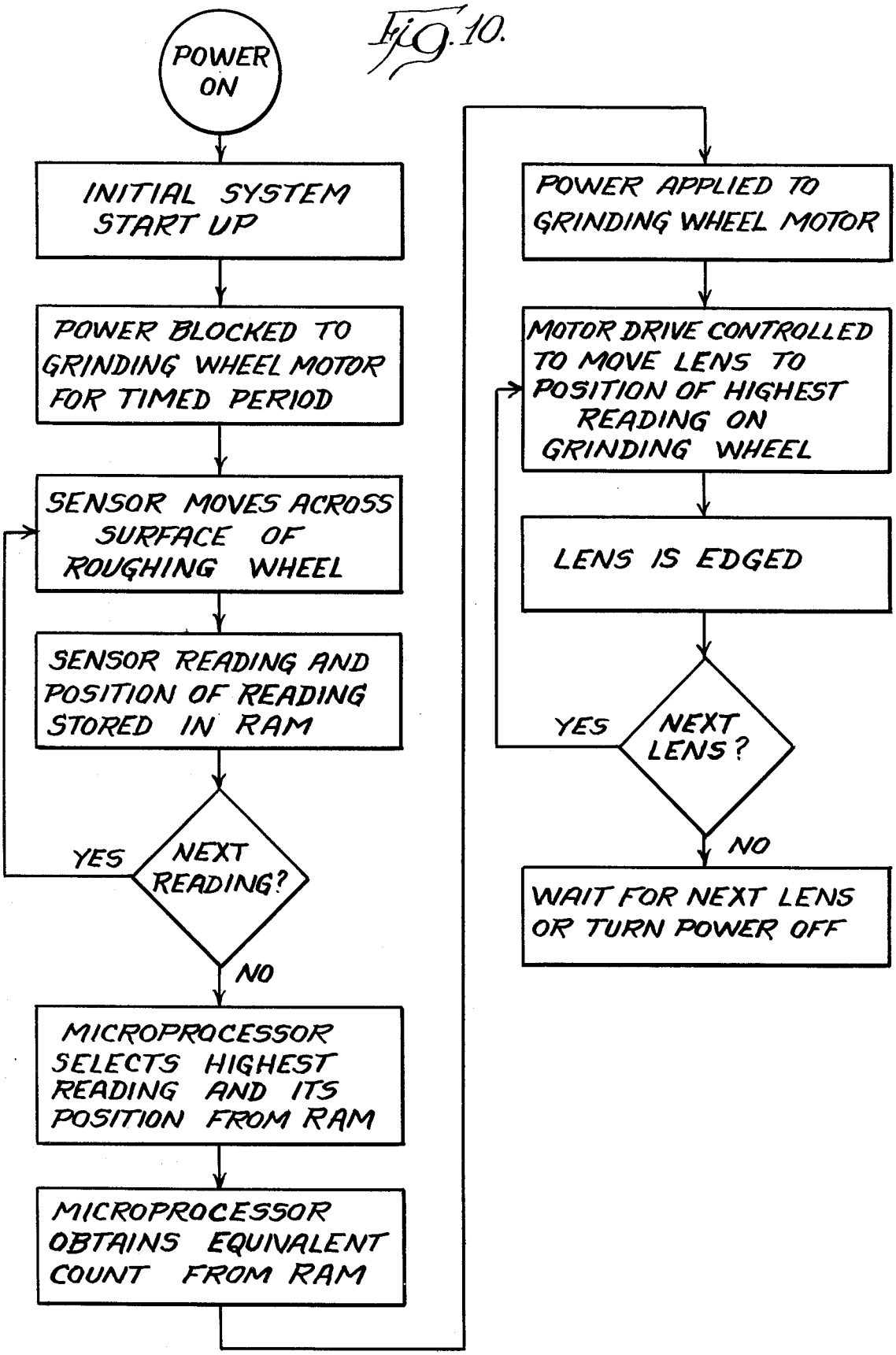
Fig. 10.
POWER ON
INITIAL SYSTEM START UP
POWER BLOCKED TO GRINDING WHEEL MOTOR FOR TIMED PERIOD
SENSOR MOVES ACROSS SURFACE OF ROUGHING WHEEL
SENSOR READING AND POSITION OF READING STORED IN RAM
NEXT READING?
YES
NO
MICROPROCESSOR SELECTS HIGHEST READING AND ITS POSITION FROM RAM
MICROPROCESSOR OBTAINS EQUIVALENT COUNT FROM RAM
POWER APPLIED TO GRINDING WHEEL MOTOR
MOTOR DRIVE CONTROLLED TO MOVE LENS TO POSITION OF HIGHEST READING ON GRINDING WHEEL
LENS IS EDGED
NEXT LENS?
YES
NO
WAIT FOR NEXT LENS OR TURN POWER OFF

METHOD OF EDGING LENSES

This application is a divisional application of application Ser. No. 19,767, filed Mar. 12, 1979 now U.S. Pat. No. 4,233,784.

BACKGROUND OF THE INVENTION

The present invention relates to a method for grinding articles, and in particular to a method for grinding the edges of ophthalmic lenses with a grinding wheel in a manner which automatically, smoothly and evenly wears the grinding surface and significantly increases the useful life of the wheel.

The present invention is particularly adapted, but not necessarily limited, to be used in connection with an apparatus for grinding the peripheries of eyeglass lenses. In one such known type of apparatus a lens is carried in a rotary work holder driven by a motor, such that the edge of the lens may engage grinding wheels driven by another motor. The work holder is mounted on a carriage for movement toward and away from the grinding wheels, as well as in directions parallel to the axis of the wheels. The edge of the rotating lens is first brought against a cylindrical outer peripheral surface of a roughing wheel to rough grind the outer periphery of the lens to a desired shape. The lens is then shifted into engagement with a V-shaped groove of a beveling wheel to form a projecting bevel on the periphery of the lens. During the beveling operation the work holder is rendered free to travel from side to side in order that the edge of the lens will be automatically centered in the groove in the wheel. The resulting bevel on the edge of the lens enables or facilitates mounting of the lens in an eyeglass frame.

While the work holder and lens are free to move axially of the beveling wheel during the beveling operation, it has been found that if axial movement is imparted to the lens during the roughing operation forces are exerted on the lens which often result in breaking, fracturing or chipping of the lens. During the roughing operation, therefore, the lens and roughing wheel are restricted against axial movement with respect to each other. In consequence, with conventional apparatus the edges of successive lenses are usually engaged with the same portion of the grinding surface of the roughing wheel, and a groove is formed in the surface.

Roughing wheels for grinding eyeglass lenses are usually comprised of an inner metal body having a cylindrical outer surface to which is bonded a layer of an abrasive material. The abrasive material, which ordinarily is diamonds in a metal matrix, has a thickness of about 0.1", and defines the cylindrical grinding surface. The width of the surface is relatively large as compared with the thickness of the lenses in order to ensure uniform contact with the entire edge surfaces of the lenses.

Although the groove forms relatively slowly in such wheels, after about 5,000 lenses have been edged the groove is ordinarily of a depth that requires retruing of the wheel. The surface of the wheel must then be reshaped or removed to the depth of the groove to again provide a cylindrical grinding surface on the wheel. Typically, such roughing wheels are capable of grinding only about 8,000 to 12,000 lenses before insufficient abrasive material remains to enable the wheel to be further retrued.

Not only are roughing wheels expensive because of the nature of the abrasive material, but retruing itself adds cost to use of the wheels. In addition, since only the center area of the wheel is ordinarily employed in the grinding operation, the side areas are never used, and in fact are removed during retruing. Consequently, despite a considerable amount of diamond abrasive material being initially provided on the wheel, when the wheel is used in a conventional apparatus only a small portion of the material is ever actually used to grind the lenses, and the remainder is wasted.

In an attempt to overcome the aforementioned disadvantages, one prior art technique contemplates providing manually operable means to axially orient the work holder and the roughing wheel relative to each other, so that the edges of successive lenses may be positioned to engage selected and different portions of the grinding surface. Ideally, an operator would orient the lenses and roughing wheel relative to each other at a frequency and in a manner to cause even wear of the grinding surface. Unfortunately, in practice such orientation is usually neglected until a groove is visible in the surface of the wheel, by which time the surface is already noncylindrical and requires reshaping. Even where the operator conscientiously changes the orientation of successive lenses and the wheel, it is unlikely that all of the various portions of the grinding surface will be engaged at a frequency and in a manner that evenly wears the wheel.

A significant advance in lens edging is disclosed in the Vulich et al U.S. Pat. No. 4,176,498, which issued Dec. 4, 1979, and is assigned to the assignee of the present invention. As taught therein, during grinding a lens is engaged with only a poriton of a grinding wheel surface, and to prevent a groove from being formed in the wheel successive lenses are automatically and periodically engaged with different portions of the wheel in a predetermined sequence of indexing across the surface. Ideally, the sequence is such that the edges of successive lenses are engaged with different portions of the grinding surface in a manner and at a frequency which ensures uniform and even wear of the entire grinding surface. Indeed, it has been found that while a grinding wheel when used in a conventional manner may be expected to grind only on the order of 10,000 lenses during its useful life, the same wheel when used to grind lenses in accordance with the teachings in the application can reasonably be expected to grind on the order of 25,000 or more lenses.

A disadvantage of the apparatus disclosed in the Vulich et al patent is that the sequence of indexing is determined on the basis of lens grinding conditions that are reasonably expected to be encountered. It occasionally happens, however, that unexpected variations are introduced into use of the apparatus which may result in uneven wear of the grinding surface. For example, in determining the number of discrete grinding positions on the surface of the wheel, it is assumed that the lenses will have some average edge thickness. Nevertheless, it is possible to encounter an extended run of either high power or low power lenses having edge thicknesses well out of tolerance with the average thickness anticipated, in which case all portions of the grinding surface will not be uniformly engaged in the predicted manner and the surface will not wear evenly. Also, while glass lenses cause wear of the wheel, for all practical purposes plastic lenses do not, so that if plastic lenses are interspersed with glass lenses it might happen that they will be edged in an order which most often engages the same portion of the grinding surface, while the glass lenses are engaged with the other portions, whereby again the wheel will not wear evenly.

It would, therefore, be extremely desirable to provide some means for automatically orienting lenses and a grinding wheel relative to each other in a manner that provides even wear of the wheel and use of all of the abrasive material thereon irrespective of the edge thickness and/or composition of the lenses, whereby to maintain a smooth grinding surface irrespective of conditions encountered without any need to rely on an operator's observations of the wear characteristics of the wheel.

OBJECTS OF THE INVENTION

An object of the present invention is to provide an apparatus for grinding disc-shaped articles with a grinding wheel in a manner that smoothly and uniformly wears the entire grinding surface of the wheel irrespective of the grinding conditions encountered, the overall shape of the article and/or the composition of the articles.

Another object of the invention is to provide such an apparatus wherein successive articles to be ground are always brought into engagement with the highest point on the surface of the grinding wheel, whereby the wheel wears evenly and the number of articles that may be ground with the wheel during its useful life is significantly increasesd.

SUMMARY OF THE INVENTION

In accordance with the present invention, a method for grinding the peripheries of articles, such as the edges of ophthalmic lenses, comprises the steps of rotating a grinding wheel about its axis, for supporting an article with a work holder, and moving the work holder and the grinding wheel relative to each other to move an edge of the article into engagement with a portion of the grinding surface. To ensure that the grinding surface wears absolutely smoothly and evenly, also included are steps of detecting the highest point on the surface, and engaging the edges of individual or successive articles with that point to impart primary wear to that portion only of the surface. In this manner, the surface wears evenly and uniformly and maintains its shape without a groove being formed therein.

In a preferred embodiment, detecting the high point comprises moving across the grinding surface while the wheel is at rest, and generating voltage signals representative of the height of the surface at sensed points therealong. The signals are monitored, and after the width of the surface has been sensed an indication is generated of the point whereat the surface is highest. The indication is then used to control movement of the work holder to position an article for movement against the high point. The article may then be ground, whereafter the described sequence is repeated for the next successive article. In the alternative, after sensing the high point a plurality of successive articles may be ground prior to resensing the height of the surface. In this manner, individual or successive lenses are automatically engaged with only the highest point on the grinding surface, whereby the surface is evenly worn.

The foregoing and other objects, advantages and features of the invention will become apparent from a consideration of the following detailed description, when taken in conjunction with the accompanying drawings.

BRIEF DESCRIPTION OF THE DRAWINGS

FIG. 10 is a flow chart of the operation of the system in grinding lenses in a manner which ensures that the grinding surface is worn absolutely evenly.

DETAILED DESCRIPTION

Figure 1:
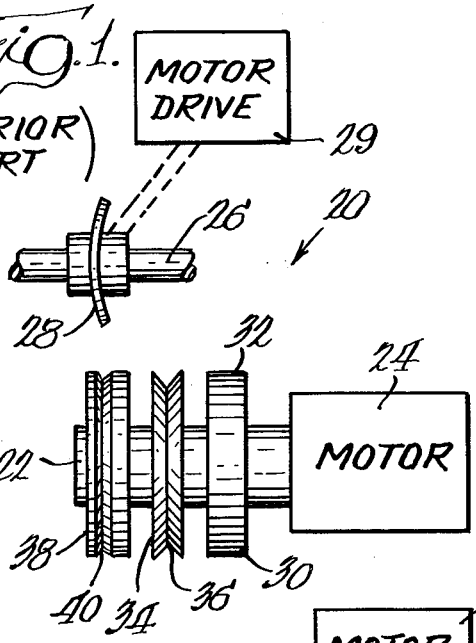
Fig. 1. (PRIOR ART)
FIG. 1 is a diagrammatic representation of an apparatus for edging disc-shaped articles, such as ophthalmic lenses, in accordance with the teachings of the prior art.

Referring to FIG. 1, there is shown in diagrammatic form and indicated generally at 20 an apparatus of a type well known in the art for grinding the edges or peripheries of articles, such as ophthalmic or eyeglass lenses. The apparatus includes a plurality of grinding wheels secured on a shaft 22 adapted to be driven at high speeds by a motor 24. A rotary work holder 26 for supporting a lens 28 is mounted adjacent to the grinding wheels along an axis of rotation substantially parallel to that of the wheels, and means such as a motor drive 29 are provided to rotate the work holder and to move the holder toward and away from the grinding wheels, as well as axially thereof, through a connection indicated schematically by the dashed lines and in a manner as is well known in the art. To protect an operator of the apparatus against flying chips and the like, in use of the apparatus the same is usually mounted within a housing with the work holder being accessible through a windowed door. One such type of apparatus is shown in Canadian Pat. No. 776,380, issued Jan. 23, 1968, to which reference is herein made.

As is conventional in lens grinding apparatus, a first one of the grinding wheels comprises a roughing wheel 30 having a cylindrical outer periphery 32 of an abrasive material which usually is comprised of diamonds in a metal matrix bonded or otherwise adhered to the wheel to a thickness on the order of 0.1". In the manufacture of a lens for mounting in an eyeglass frame the lens, which usually is already ground and polished to a desired prescription, is mounted in the work holder and its edge moved into engagement with the grinding surface 32 while the work holder is rotated. Simultaneously, the work holder is moved toward and away from the roughing wheel in a controlled manner for grinding the edge of the lens to a predetermined outline in conformity with the configuration of the lens mounting opening in the eyeglass frame. As is known, means for controlling movement of the work holder toward and away from the roughing wheel may include a pattern or cam connected with the work holder for guiding its movement and having a configuration corresponding in shape to the desired outline of the lens, and an adjusting mechanism for controlling the overall dimensions to which the lens is ground.

The width of the grinding wheel surface is ordinarily several times greater than the thickness of a lens, and with conventional lens edging apparatus the work holder is usually axially positioned to engage the edges of lenses with the center of the surface. The result is that a groove is worn in the surface, portions of the surface to either side of the groove are not used in grinding, the wheel requires frequent retruing or reshaping to return its surface to cylindrical, and the useful life of the wheel is relatively short. In particular, a roughing wheel when used in conventional lens edging apparatus is capable of grinding only on the order of 8,000 to 12,000 lenses before it must be replaced, usually at considerable expense.

A second one of the grinding wheels is a beveling wheel 34 which has a relatively large V-shaped groove 36 in its outer periphery. The lens and the grinding wheels are supported in substantially parallel planes, and after the rough grinding operation the work holder is operated by the motor drive to move the edge of the rotating lens into the V-shaped groove. During the beveling operation the lens is rendered free to travel from side to side, in order that its edge will be automatically centered in the groove. The resulting bevel on the edge has an apex located about midway between the faces fo the lens.

For relatively thin lenses, centering of the apex midway between the faces of the lens is acceptable, since the bevel is not likely to be visible from the front when the lens is mounted in an eyeglass frame. With thicker lenses, however, it is cosmetically desirable to provide a relatively small bevel adjacent the front side of the lens, in order that the bevel will not be visible from the front when the lens is mounted in a frame. For this purpose, a second beveling wheel 38, which has a relatively small V-shaped groove 40, is also provided. In the use of the wheel 38, after a relatively thick lens has been rough ground, and with the front of the lens facing left as shown in FIG. 1, the work holder moves the front edge of the rotating lens into the groove 40 while the lens is rendered free to travel from side to side. To ensure that the forward edge of the lens remains in the V-shaped groove, the lens is normally urged to the left and an arm (not shown) is engaged with the front face of the lens to deflect the lens and maintain its forward edge in the groove. In consequence, the bevel is formed on the lens around the side of the edge and adjacent to the front face thereof.

Figure 2:
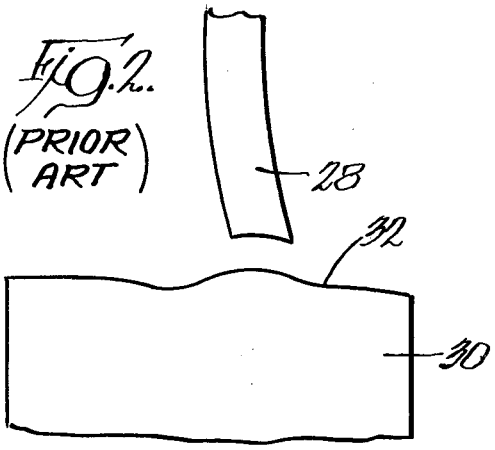
Fig. 2. (PRIOR ART)
FIG. 2 is an enlarged, fragmentary view of the surface of a grinding wheel and a lens for being edged thereby, illustrating the uneven wear of the grinding surface when the wheel is used with conventional edging apparatus.

As previously stated, the lens usually is always engaged with the center of the surface 32 of the grinding wheel, whereby a central groove forms in the surface. In the alternative, the prior teachings contemplate manually positioning the lens to engage different portions of the surface or, as described in the aforementioned U.S. Pat. No. 4,176,498, automatically sequentially indexing the lens to discrete and preselected positions on the surface. Fig. 2 illustrates a typical configuration assumed by the grinding wheel surface when the lens is manually indexed to selected positions thereon, although for a lens automatically indexed in accordance with the teachings of U.S. Pat. No. 4,176,498 the illustration is considerably exaggerated. In any event, it is apparent that the surface of a grinding wheel when used with apparatus contemplated by the prior art wears in a nonlinear, uneven fashion, with the result that the useful life of the grinding wheel is less than otherwise obtainable.

To the extent described, the apparatus of FIG. 1 is embodied in the present invention. In accordance with the teachings of the invention, however, means are also provided for automatically sensing the highest point on the surface 32 of the grinding wheel, and for then engaging the peripheries of individual or successive articles or lenses with that point to impart primary wear thereto until such time as another point becomes highest. In consequence, the wheel wears evenly, formation of grooves in its surface is prevented, the need to retrue the wheel is eliminated, and the entirety of the abrasive material on the wheel is utilized, whereby the life of the wheel is significantly extended.

Figure 3:
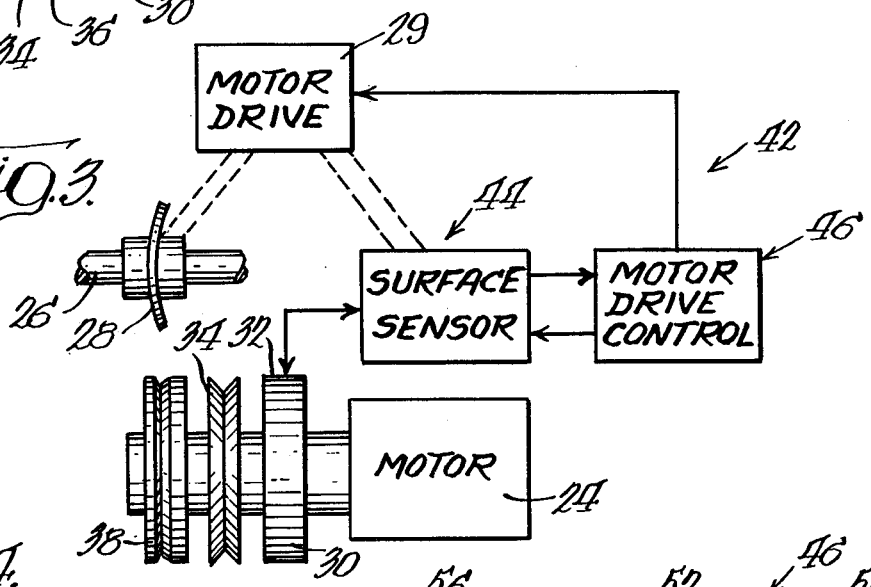
FIG. 3 is a simplified, block diagram representation of the apparatus of the invention for automatically sensing and grinding lenses against the highest point on the surface of a grinding wheel, whereby the surface is worn absolutely evenly.

Referring to FIG. 3, there is indicated generally at 42 one contemplated embodiment of an apparatus for edging lenses in accordance with the present invention. The apparatus includes a surface sensor 44 and a motor drive control 46 which together detect the position of the highest point on the surface 32 of the grinding wheel 30, and then control the motor drive 29 to move the edge of a lens against that point. The level of the surface may be sensed for each individual lens ground, but for the sake of economy is preferably sensed only periodically after a number of successive lenses have been edged. As indicated schematically by dashed lines, in sensing the height of the surface the sensor 44 is moved across the surface and at a predetermined speed by the motor drive 29, the motor drive also moving the work holder 26 to transport the lens.

Figure 4:
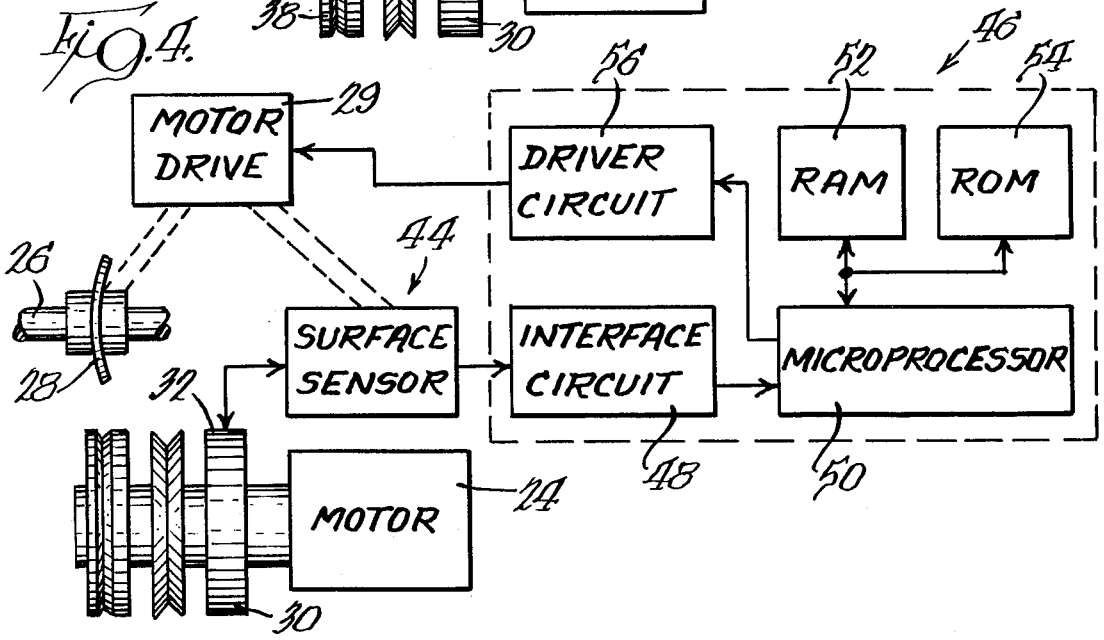
FIG. 4 is similar to FIG. 3, except that the major elements of the motor drive control are shown in block diagram form.

With reference to FIG. 4, the motor drive control 46 may comprise an interface circuit 48 for connecting an output from the surface sensor 44 with a microprocessor circuit 50, a random access memory circuit (RAM) 52 and a read only memory circuit (ROM) 54 interfaced with the microprocessor, and a driver circuit 56 under control of the microprocessor for operating the motor drive 29 to move the work holder 26 and/or the surface sensor 44. In operation of the circuit, and upon initial startup of the assembly with the motor 24 held off through a delay timer (not shown) and the grinding wheels at rest, the surface sensor is moved in contact with and across the width of the grinding surface in a direction parallel to the axis of the wheel to provide to the interface circuit 48 a plurality of discrete signals the values of which represent the height of the surface at discrete points therealong. The interface circuit connects the signals with the microprocessor, which in turn applies each signal to the RAM for temporary storage at a discrete location therein, each location being representative of a discrete position on the surface of the wheel. After the level of the surface has been sensed the delay timer times out and the motor 24 is energized, and the microprocessor determines at which location in the RAM is stored the signal representative of the highest point on the surface of the wheel.

In accordance with the particular location selected, the microprocessor then obtains from the ROM and applies to the driver circuit 56 a signal which operates the motor drive 29 to move the work holder 26 to position the edge of the lens for being moved against the highest point on the grinding wheel surface. Successive lenses are then edged against that point until such time as the RAM is reset, which may occur after each lens is edged or only after a plurality of lenses are edged. In a preferred embodiment, and since the surface of the wheel wears relatively slowly, it has been found that the surface may be maintained absolutely even if resetting of the RAM is under control of a master on-off switch for the apparatus, such that anywhere from one to several hundred lenses are edged against a detected high point prior to again detecting the high point on the surface.

Figure 5:
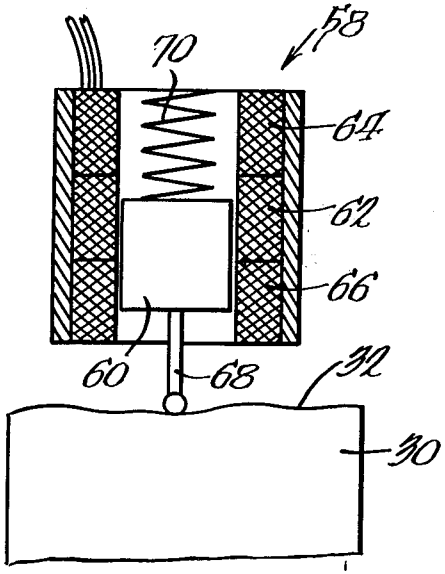
FIG. 5 is an enlarged, cross-sectional elevation view of a sensor for detecting the height of the grinding wheel surface at discrete positions therealong.

An embodiment of a sensor particularly adapted for scanning the grinding surface 32 is illustrated in FIG. 5, and comprises a linear variable differential transformer (LVDT) indicated generally at 58. The LVDT has a cylindrical core 60 of magnetic material positioned axially within a coil assembly including an annular primary coil 62 in coaxial alignment with a pair of annular secondary coils 64 and 66 connected in series opposition. With an a.c. voltage applied across the primary coil, the output voltage from the LVDT as taken across the secondary coils is a function of the position of the core within the coils, is zero volts when the core is centered, and when the core is other than centered is either positive or negative and of a magnitude in accordance with the displacement and direction of displacement of the core from center. A surface height sensing rod 68 extends from one end of the core for sliding movement across the grinding surface 32, and a spring 70 urges the core toward the surface to maintain the rod in contact therewith. In this manner, when the LVDT is moved across the surface by the motor drive 29 the core is displaced within the coil in accordance with the configuration of the surface, thereby providing an output voltage from the secondary coils having a value representative of the height of the surface.

Figure 6:
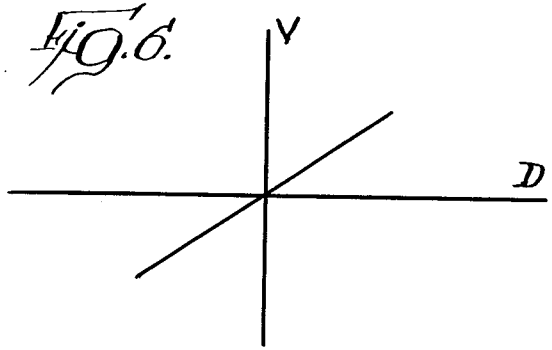
FIG. 6 is a graph illustrating a voltage output from the sensor of FIG. 5 as a function of the depth or height of the grinding surface.
Figure 7:
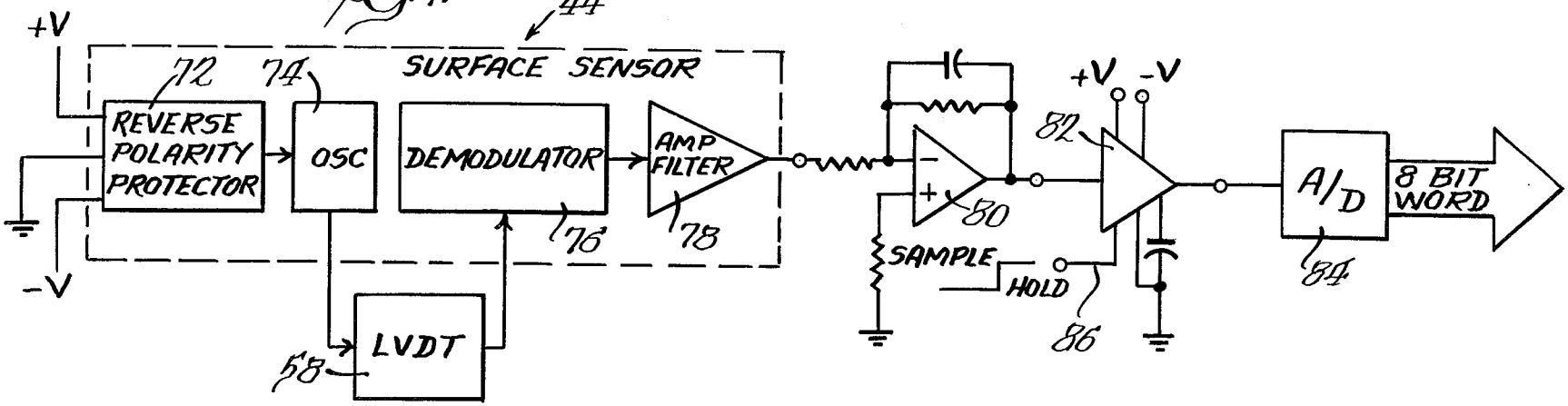
FIG. 7 illustrates partly in block diagram and partly in schematic form the elements of the surface sensor of FIGS. 3 and 4.

As shown in FIG. 7, means for interconnecting with the LVDT 58 includes a reverse polarity protector 72 for applying a voltage to an oscillator 74, the output from which is connected as an input to the LVDT across the primary coil 62. The LVDT output from the series opposed secondary coils 64 and 66 is applied to a demodulator 76, which connects with an amplifier filter 78 to generate at the output therefrom a d.c. voltage having a magnitude and polarity, as shown in FIG. 6, in accordance with the displacement of the core 60 as the rod 68 moves across the grinding surface 32. The output from the amplifier filter is applied through a buffer filter amplifier 80 to the input to a sample and hold circuit 82, the output from which is connected to an analog to digital (A/D) convertor circuit 84.

In operation of the surface sensor circuitry, and with reference also to FIG. 4, as the sensing rod 68 of the LVDT 58 is moved across the grinding wheel surface by the motor drive 29 at the predetermined speed, a plurality of clock pulses are applied by the microprocessor 50 to an input 86 to the sample and hold circuit 82. The clock pulses occur at a predetermined frequency, and therefore each is representative of a discrete point along the surface of the grinding wheel. The arrangement is such that when the clock voltage is positive the circuit 82 samples the output voltage from the amplifier 80, the value of which represents the height of the portion of the grinding surface then being contacted by the sensing rod 68, and when the voltage is zero the circuit generates and maintains at its output and at the input to the A/D circuit 84 an analog voltage the value of which is representative of the height of the point on the grinding surface last contacted. The A/D circuit is connected with the microprocessor, and during the hold cycle of the circuit 82 is controlled to provide at its output a binary eight bit word which is representative of the magnitude and polarity of the analog voltage then at its input. The binary output is applied by the microprocessor to the RAM for storage therein, and the RAM is clocked simultaneously with the circuit 82 so that successive ones of its storage positions are enabled to receive successive outputs from the A/D circuit 84, whereby indications of the height of the grinding surface at discrete positions therealong are stored at corresponding discrete locations in the RAM.

As previously described, after the entire grinding surface is scanned by the LVDT, the microprocessor determines at which location in the RAM is stored a signal representative of the greatest grinding surface height, which location is thus indicative of the position on the grinding wheel surface whereat such height was detected.

Figure 8:
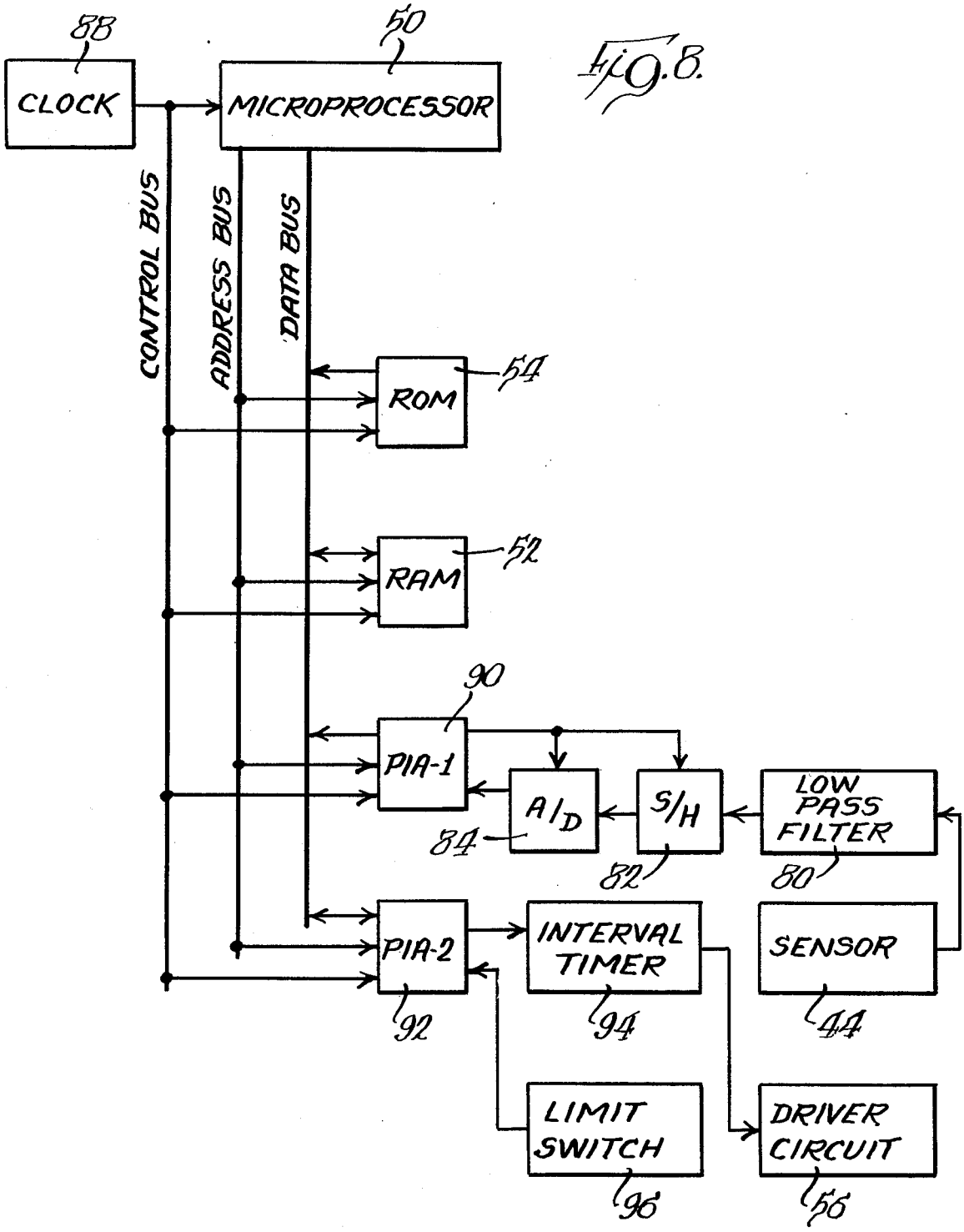
FIG. 8 illustrates in block diagram form an overall circuit in accordance with the teachings of the invention for sensing the highest point on the grinding surface and for positioning a lens to be engaged therewith.

An overall representation of the system is illustrated in FIG. 8, which also includes a clock 88 for indexing the system through its various stages and a first peripheral interface adapter circuit (PIA-1) 90 which interfaces the sample and hold circuit 82 and the A/D circuit 84 with the microprocessor 50, RAM 52, ROM 54 and clock 88. It is to be appreciated that all of the system permanent memory or software, including that required for startup and resetting of the system, resides in the preprogrammed ROM, the RAM merely acting as a temporary data storage facility for the eight bit data representative of grinding wheel surface height at discrete positions thereon, as provided from the A/D circuit through the peripheral interface adapter 90, for example 750 height indications for a grinding wheel of 1.5 centimeters thickness.

In order to position the lens opposite the highest point on the grinding wheel surface as determined by the microprocessor from the information stored in the RAM, and as also shown in FIG. 8, a second peripheral interface adapter circuit (PIA-2) 92 connects with the driver circuit 56 through an interval timer 94, and receives at an input thereto an output from a limit switch 96. In operation of this portion of the circuit, upon the microprocessor determining the position of the highest point on the grinding surface from the information stored in the RAM, a count having a value in accordance with the position is advanced from the ROM into the interval timer. The limit switch 96 is positioned to sense an initial rightward or home position of the work holder, and upon movement of the work holder to the home position the limit switch closes and applies an input to the peripheral interface adapter 92 to initiate operation of the interval timer 94. The interval timer then operates the driver circuit 56 to turn on the motor drive 29 and move the work holder 26 to the left at the predetermined speed while clock pulses at a selected rate are simultaneously applied to the interval timer to reduce the count stored therein. The arrangement is such that the count initially advanced into the interval timer, as derived from information stored in the RAM, is reduced to zero when the work holder has positioned the lens 28 opposite from or for engagement of its edge with the highest point on the grinding surface. When the count in the interval timer is reduced to zero, the driver circuit 56 deenergizes the motor drive to stop movement of the work holder, whereupon the lens is moved against the high point on the grinding surface.

For example, assume that the motor drive 29 moves the work holder at a rate of 1 centimeter per 500 milliseconds, and that at the home position the lens is positioned opposite from the right edge of the wheel. Under this circumstance, if the high point on the grinding surface is found to be 0.5 centimeter from the right edge thereof, then movement of the lens to the high point will require 250 milliseconds. If the interval timer is counted down by a 1 kHz clock, then the ROM would be programmed, on the basis of information obtained from the RAM, to store an initial count of 250 in the interval timer, whereby upon simultaneous count down of the interval timer and actuation of the motor drive the count will reach zero to stop the motor drive when the lens is positioned opposite the high point on the grinding surface.

Figure 9:
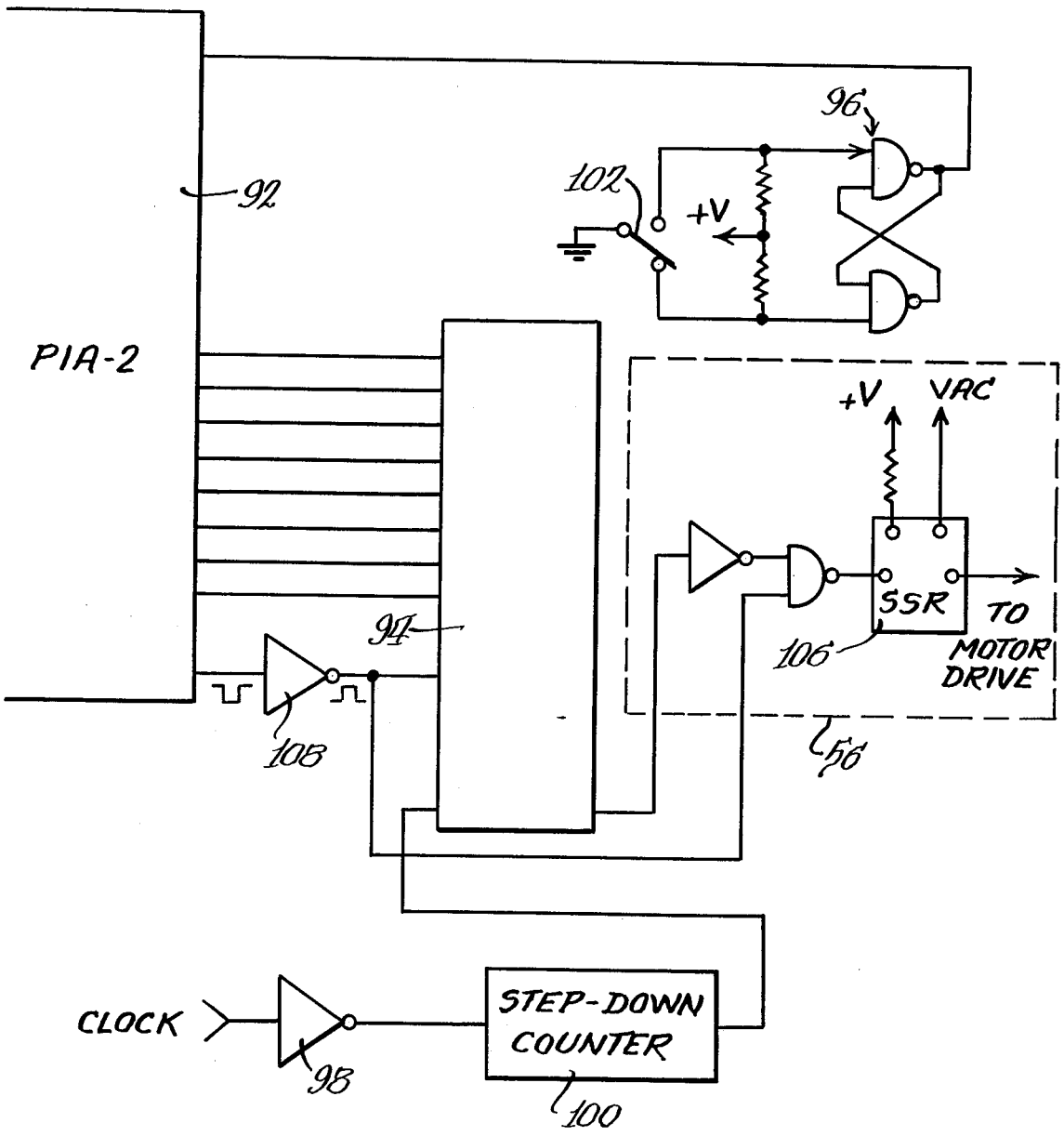
FIG. 9 is a combined schematic and block diagram representation of the interval timer shown in FIG. 8, for operating the motor drive to position a lens for engaging the highest point on the grinding surface.

The arrangement of the driver circuit 56, the interval timer 94 and the limit switch 96 is illustrated in greater detail in FIG. 9. In particular, the interval timer receives from the ROM and microprocessor through the peripheral interface adapter 92 an eight bit binary count of a value representative of the position of the highest point on the grinding wheel surface. Since the rate of the clock 88 for the microprocessor system is ordinarily quite high, usually on the order of 1 mHz, the clock pulses are applied through an amplifier 98 and a step down counter 100 to provide clock pulses at a considerably lower rate, or at a rate of 1 kHz for the above example, for counting down the interval timer.

In operation of the circuit, after the motor drive 29 moves the surface sensor 58 across the grinding surface and the surface height information is stored in the RAM 52, the motor drive then moves the work holder to its rightward home position to close a microswitch 102 of the limit switch 96. This applies a signal through the peripheral interface adapter 92 to the microprocessor which, on the basis of the surface height information stored in the RAM, then applies from the ROM 54 and back through the peripheral interface adapter for storage in the interval timer 94 an eight bit binary count having a value such that the time required for its reduction to zero by the output from the step down counter 100 is equal to the time required for the motor drive to move the lens from the home position to the position opposite the high point on the surface. Upon introduction of the count into the interval timer, an output is provided therefrom to the driver circuit 56, which includes a solid state relay 106, and in conjunction with a clock pulse applied through an amplifier 108 to the drive circuit causes the relay to energize and operate the motor drive to move the lens from the home position and across the grinding surface. Simultaneously, the count in the interval timer is reduced by pulses from the step down counter 100, and upon being reduced to zero its output changes to disable the driver circuit and stop the motor drive, whereupon the edge of the lens is positioned opposite from and for being moved against the high point on the grinding surface.

It is to be appreciated, that for lens movement distances greater than 0.5 centimeters, which requires more than 250 milliseconds to effect, an eight bit binary word is insufficient for the count data required. This condition, however, may readily be solved through software by using the peripheral registers customarily associated with conventional microprocessors and peripheral interface adapters of the type described.

FIG. 10 illustrates a flow diagram of the sequence of operation of the system where the highest point on the grinding surface is sensed only upon the application of power to the apparatus and whereafter, until the apparatus is turned off and then on again, successive lenses are always ground against the last detected high point. Note from the flow diagram that as the sensor moves across the grinding wheel surface the readings generated thereby as well as the positions of the readings are periodically stored in the RAM. The positions may be represented by an eight bit data word, whereby for each reading two eight bit data words are stored in the RAM, one for the height of the surface and the other for the axial position along the surface whereat the height reading was obtained. Thus, after the surface is scanned, the RAM may simply be addressed to find the position of the high point on the surface.

The invention provides an improved apparatus for edging optical lenses, in which the life of the rough grinding wheel has been significantly increased. By virtue of successive lenses being positioned to engage the high point on the surface of the wheel, as compared with always being brought into engagement with the same portion of the surface as is generally conventional, or being periodically engaged with selected discrete portions of the surface as in the aforementioned U.S. Pat. No. 4,176,498, the grinding wheel wears absolutely smoothly and evenly, retruing is not required, and the useful life of the wheel is significantly extended. More to the point, by use of the present invention the entirety of the abrasive material on the wheel may be used in grinding lenses without the need to ever waste any of the material by retruing or reshaping. Also, because the positioning of the lens is under automatic as compared with manual control, operator discretion in positioning the lens is eliminated, and orientation of the lens is always accomplished in a manner to ensure even wear of the wheel. In particular, while a grinding wheel used in a conventional manner may be expected to grind only on the order of 10,000 lenses during its useful life, the same wheel when used to grind lenses in accordance with the teachings of the invention can reasonably be expected to grind on the order of 50,000 lenses or more. Consequently, the invention advantageously results in an improved life of grinding wheels, and elimination of down time of the apparatus for the purpose of retruing the wheels.

A further advantage provided by the invention is an extended life of the beveling wheels. Since the roughing wheel wears evenly and maintains a cylindrical shape, lenses ground therewith have axially flat edges. When such a lens is beveled, the flat edge of the lens is removed by the two angular faces of the V-shaped beveling groove, and the apex of the groove removes a minimum of material and retains its shape. In the case of lenses ground with a grooved roughing wheel, however, the lens edge is not axially flat, but instead conforms in shape with the groove. In consequence, when such lenses are beveled, the apex of the V-shaped beveling groove removes a considerable amount of material and is subject to excessive wear, resulting in a shortened useful life of the beveling wheel.

Also, since the surface of the grinding wheel remains axially flat, the distances between the axis of rotation of a lens and all laterally opposite portions of the grinding surface are the same. Thus, irrespective of the particular axial orientation of lenses with respect to the grinding wheel, the peripheries of successive lenses may readily be ground to precisely determined overall dimensions, which is extremely desirable for conformably fitting optical lenses within specifically dimensioned openings in eyeglass frames.

While embodiments of the invention have been described in detail, various modifications and other embodiments thereof may be devised by one skilled in the art without departing from the spirit and the scope of the invention, as defined by the appended claims.

What is claimed is:

1. In a method of grinding an article with a grinder having a grinding surface and an axis of rotation, comprising the steps of detecting the height of discrete axial positions on the grinding surface between opposite sides thereof and generating signals having values representative thereof; comparing the values of said signals and generating an indication of the grinding surface axial position whereat said signals represent greatest height; and moving the article in accordance with said indication against the axial position of greatest height.

2. In a method of grinding the peripheries of articles such as ophthalmic lenses and the like with a grinding wheel having a grinding surface and an axis of rotation, comprising the steps of detecting the height of discrete axial positions on the grinding surface between opposite sides thereof and generating signals having values representative thereof; comparing the values of said signals and generating an indication of the axial position on the grinding surface whereat said signals represent greatest height; and moving the periphery of an article in accordance with said indication against the axial position of greatest height.

3. In a method as in claim 2, said comparing and indication generating step comprising periodically sampling the values of said signals, storing an indication of the values of said sampled signals and of the detected axial positions on the grinding surface whereat said sampled signals were generated, comparing the relative values of said stored signals, and indicating the axial position on the grinding surface whereat said signals represent greatest height.

4. In a method as in claim 2, said detecting step comprising detecting the height of the grinding surface at incrementally spaced axial positions between said edges thereof and generating signals having values representative thereof, said comparing and indication generating step comprising storing the value of each generated signal, comparing the values of said stored signals, and generating an indication of the axial position on the grinding surface whereat said signals represent greatest height, said moving step comprising moving the article from an initial position and across the grinding surface at a predetermined speed and for a time in accordance with said indication, said indication controlling the time of movement of the article so that the article is positioned to engage the highest position on the grinding surface, and thereafter moving the article against the highest position.

5. In a method as in claim 4, including the steps of generating a count having a value in accordance with said indication, and reducing the value of said count at a predetermined rate to a predetermined value, said moving step comprising moving the article from the initial position and across the grinding surface while said count is being reduced to said predetermined value, said count being of an initial value such that the article is positioned to engage the highest position on the grinding surface upon said count being reduced to said predetermined value.

6. In a method as in claim 5 said predetermined value of said count being zero.

7. A method of grinding an article, comprising the steps of rotating a grinding wheel, having a grinding surface which is subject to wear, about its axis; supporting and moving the article against the grinding surface; detecting the axial position of the highest point on the grinding surface between opposite sides of said surface; and controlling said supporting and moving step in accordance with said detecting step to locate the article opposite from and to move the article against the highest point position.

8. A method as in claim 7, wherein said detecting step comprises detecting the height of discrete positions on the grinding surface along a line extending between opposite sides of the surface.

9. A method as in claim 8, wherein said detecting step comprises sensing the height of the discrete positions on the grinding surface along the line between opposite sides thereof, generating signals having values representative of the sensed height of the discrete positions, and monitoring the signals and controlling operation of said supporting and moving steps in accordance therewith to move the article against the discrete position on the surface whereat the signals indicate the surface is highest.

10. A method as in claim 9, wherein said monitoring step includes periodically sampling the values of the signals, storing indications of both the values of the signal samples and the positions on the surface whereat said signal samples are obtained, comparing said stored indications to determine the position on the surface whereat the surface is highest, and controlling operation of said supporting and moving step to move the article against the determined position.

11. A method of grinding the peripheries of articles such as ophthalmic lenses and the like, comprising the steps of rotating a grinding wheel, having a grinding surface which is subject to wear, about its axis; supporting a lens generally along an axis thereof and moving the edge of the lens against the grinding surface; detecting the axial position of the highest point on the grinding surface between opposite sides of said surface; and controlling said supporting and moving step in response to said detecting step to locate the edge of the lens opposite from and to engage the edge of the lens with the grinding surface at the axial position whereat the surface is highest, whereby the grinding surface wears evenly and uniformly.

12. A method as in claim 11, wherein said detecting step comprises sensing the height of discrete positions on the surface between opposite sides thereof along a line extending generally parallel to the grinding wheel axis.

13. A method as in claim 11, wherein said detecting step includes generating voltage signals having values in accordance with the height of each discrete sensed position on the surface, and monitoring the values of the signals and generating an indication of the axial position on the surface having the greatest height, said supporting and moving step being responsive to said indication generating step to locate the edge of the lens opposite from and to engage the edge of the lens with said position on the surface having the greatest height.

* * * * *